US005953003A

United States Patent [19]

Kwon et al.

[11] Patent Number: 5,953,003

[45] Date of Patent: Sep. 14, 1999

[54] FLAT DISPLAY DATA DRIVING DEVICE USING LATCH TYPE TRANSMITTER

[75] Inventors: Oh Kyong Kwon; Young Sun Na; Chang Ho Hyun, all of Seoul; Gun Mu Her, Busan, all of Rep. of Korea

[73] Assignee: Orion Electric Co. Ltd., Kyungsangbuk-do, Rep. of Korea

[21] Appl. No.: 08/875,544

[22] PCT Filed: Nov. 30, 1996

[86] PCT No.: PCT/KR96/00226

§ 371 Date: Oct. 6, 1997

§ 102(e) Date: Oct. 6, 1997

[87] PCT Pub. No.: WO97/20300

PCT Pub. Date: Jun. 5, 1997

[30] Foreign Application Priority Data

Nov. 30, 1995 [KR] Rep. of Korea ..... 95-45455

[51] Int. Cl.[6] ..... G09G 5/00

[52] U.S. Cl. ..... 345/204; 345/74; 345/75; 315/169.1

[58] Field of Search ..... 345/204, 74, 75, 345/212, 92, 96, 94, 98, 99, 100, 77, 78; 315/169.1, 169.3, 307, 169.4, 349; 313/309, 495

[56] References Cited

U.S. PATENT DOCUMENTS 5,210,427 5/1993 Uchida et al. ..... 250/551
5,210,472 5/1993 Casper et al. ..... 315/349
5,638,085 6/1997 Hush et al. ..... 345/74
5,734,361 3/1998 Suzuki et al. ..... 345/74

FOREIGN PATENT DOCUMENTS

WO 88/01098 2/1988 WIPO .
WO 94/15350 7/1994 WIPO .

*Primary Examiner*—Richard A. Hjerpe
*Assistant Examiner*—Francis N. Nguyen
*Attorney, Agent, or Firm*—Merchant & Gould, P.C.

[57] ABSTRACT

A flat display driving includes a gate driving circuit for sequentially and selectively applying a high voltage to a plurality of gate lines to drives them; a data driving circuit which includes a shift register for sequentially inputting one line of pixel data, a current source array which inputs on line of pixel data from the shift register, generates one line of current signals corresponding to each logic value of the pixel data and applies one line of current signals to the data lines and a latch type transmission array connected between the shift register and the current source array, for adjusting the supply time of one line of pixel data to be applied to the current source array, thereby driving the pixels on one horizontal line of the field emission display by the current signals for a predetermined time period; and a control circuit which processes a video signal into a series type of pixel data, supplies it to the data driving circuit and generates control signals required for the data driving circuit and gate driving circuit.

9 Claims, 6 Drawing Sheets

FLAT DISPLAY DATA DRIVING DEVICE USING LATCH TYPE TRANSMITTER

TECHNICAL FIELD

The present invention relates to a data driving device using a latch type transmission gate applicable to flat display driving devices for current driving.

BACKGROUND ART

One example of the flat displays for current driving is a Field Emission Display (hereinafter referred to as an "FED"), and the present invention proposes an improved data driving device of the field emission display using a passive matrix addressing method,.

What has been spot-lighted as a flat display is a Liquid Crystal Display (LCD), which displays image by interrupting beam from the light source using liquid. The driving method thereof is largely divided into a passive matrix addressing method and an active matrix addressing method. The passive matrix addressing method of the LCD is that different voltages are applied to the upper and lower plates of the glass substrate of the LCD, respectively, thus inputting the data to the pixel at the crossing point. This method has a disadvantage in that the adjacent pixels of the designated pixel are also affected and thus a compensating circuit for fine picture is required, resulting in a complicated driving device. The active matrix addressing method is that one pixel has a cell transistor and a capacitor and one pixel is continuously driven by the previous pixel data until the following pixel data is input, and this method permits an improved definition and a simplicity of the driving device. However, the active matrix addressing method is disadvantageous in that it requires a plurality of transistors and capacitors on the glass substrate of the LCD, thus resulting in a complicated manufacturing process and low yield. The LCD now occupies the largest part of the flat display market. However, it has some problems in that only several percentage of light from the light source actually affects the picture, resulting in greater power consumption and difficulty in large-scale area. Also, since semi-liquid material (liquid crystal) is used, the LCD is sensitive to the temperature change, weak in input, has a dark picture and a limit in resolution. In order to solve these problems, research is being conducted on the FED as a substitute flat display. The FED displays picture in a similar manner as the cathode-ray tube which displays image using the emitted electrons. However, the FED is different from the cathode-ray tube in that the FED uses Cold Electron Emission while the cachode-ray tube uses Thermal Electron Emission.

In FED, the field emission elements which emit electrons are placed at every pixel and the electrons from the field emission elements are collided with the electrode doped with fluorescent film, thus displaying the image. The FED is now being spot-lighted as a next generation flat display which can solve the above problems of the LCD.

The FED can integrate several hundreds or several thousands of field emission elements to form one pixel. Each of the field emission elements constituting the pixel of the FED has a cathode 12 connected to a cathode electrode 10, a gate electrode 14 separately arranged over the cathode 12 by a predetermined interval, and a positive plate 18, as shown in FIG. 1. The rear surface of the positive plate 18 is doped with a fluorescent film 16. The fluorescent film 16 generates light corresponding to the amount of the collided electrons, thus enabling the display of the image. The positive plate 18 serves to attract the electrons emitted from the cathode 12 and is made to be transparent so that the light from the fluorescent film 16 can be transmitted. The cathode 12 is of the horn type with a pointed part and emits electrons from the pointed part thereof by the driving power from the cathode electrode 10. The gate electrode 14 has a hole to expose the pointed part of the cathode 12. The gate electrode 14 makes the electrons to be emitted from the cathode 12 by the high voltage lower than the voltage applied to the positive plate 18, and the positive plate 18 app1ied with the high voltage accelerates the electrons emitted by the gate electrode 14 to the positive plate 18.

FIG. 2 illustrates a passive matrix driving device according to a prior art. Referring to FIG. 2, gate driving circuits 22*a*, 22*b* and 22*c* are connected to gate lines 14*a*, 14*b* and 14*c*, and cathode driving circuits 24*a* to 24*e* are connected to cathode lines 10*a* to 10*e*. At the crossing points of the gate lines 14*a* to 14*c* and cathode lines 10*a* to 10*e*, horn type of field emission elements 12 as shown in FIG. 1 are arranged. A plurality of field emission elements 12 are integrated to constitute one pixel. However, for the convenience of description, it is assumed that one field emission element 12 constitutes one pixel. Thus, FIG. 2. shows the FED having 3×5 pixels and the driving device thereof.

Another method for driving the FED, i.e. the active matrix addressing method is disclosed in U.S. Pat. No. 5,210,427 of Micron Technology Inc. In the active matrix addressing method of the Micron Technology Inc., two transistors are connected to each pixel shown in FIG. 2 and the pixel holds the data applied thereto until the following data is applied thereto in a similar manner as the active matrix addressing method of the LCD. The active matrix addressing method of the Micron Technology Inc. is advantageous in that the transistors of each pixel operate at a lower voltage and the control circuit has a simple structure. However, each pixel requires a plurality of transistors, resulting in a complicated manufacturing process. As compared therewith, the passive matrix addressing method of the FED has a simple manufacturing process. However, since it does not have the transistor and capacitor per pixel, the emission of the electrons from one pixel is limited by the length of the pulse which sequentially scans the data lines which are crossed with one gate line applied with a high voltage. The degree of the light emitted by the electrons collided with the fluorescent film 16 doped at the positive plate 18 relates to the amount of the emitted electrons and the energy of the emitted electrons reached the positive plate 18. Since the scan pulse of the cathode lines 10*a* to 10*e* of the FED is determined depending upon the system, the field emission element may not emit sufficient electrons during the above scan pulse length.

DISCLOSURE OF INVENTION

It is therefore, an object of the present invention to provide an improved flat display data driving device which can hold data and then transmit it for a predetermined time while the gate line is turned on, i.e. which can flexibly adjust the transmission time.

To achieve the above objects of the present invention, a flat display driving device of the present invention has a gate driving circuit for sequentially and selectively applying a high voltage to a plurality of gate lines to drive them; a data driving circuit which includes a shift register for sequentially inputting one line of pixel data, a current source array which inputs one line of pixel data from the shift register, generates one line of current signals corresponding to each logic value of the pixel data and applies one line of current signals to the data lines and a latch type transmission array connected between the shift register and the current source array, for adjusting the supply time of one line of pixel data to be applied to the current source array, thereby driving the pixels on one horizontal line of the field emission display by the current signals for a predetermined time period; and a control circuit which processes a video signal into a series type of pixel data, supplies it to the data driving circuit and generates control signals required for the data driving circuit and gate driving circuit.

BRIEF DESCRIPTION OF THE DRAWINGS

These and various other features and advantages of the present invention will be readily understood with reference to the following detailed description taken in conjunction with the accompanying drawing, in which.

BEST MODE FOR CARRYING OUT THE INVENTION

A preferred embodiment of the present invention will be discussed in detail with reference to the accompanying drawings.

Figure 1:
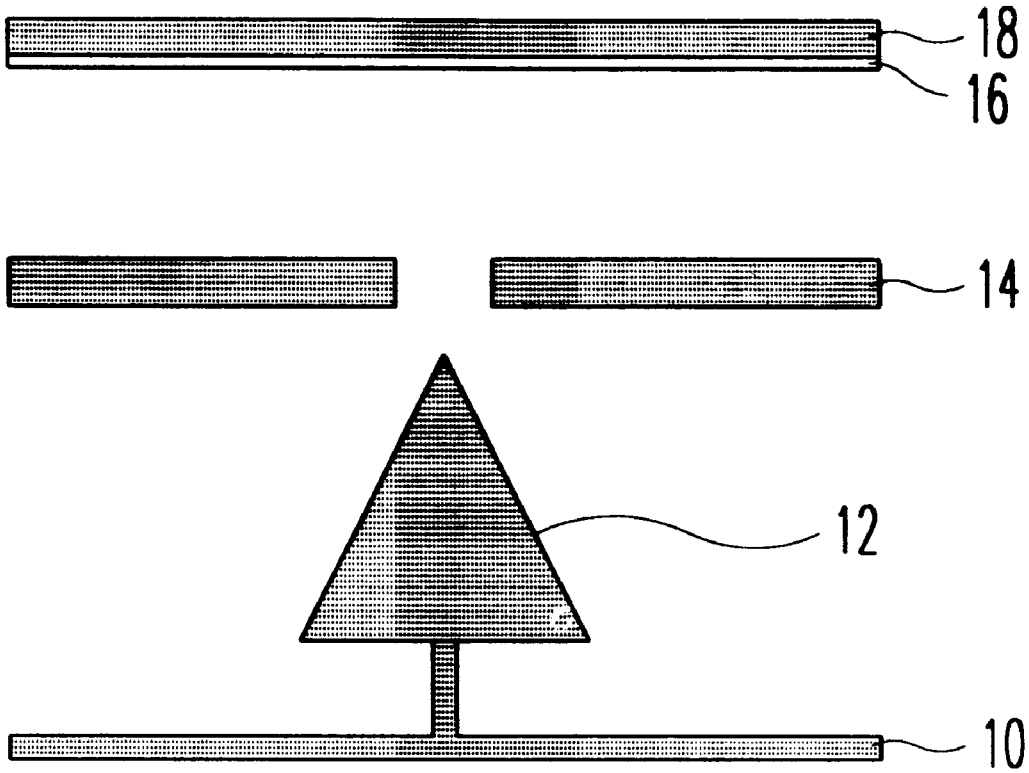
Fig. 1 (Prior Art)
FIG. 1 is a diagram showing a configuration of a typical field emission element.
Figure 2:
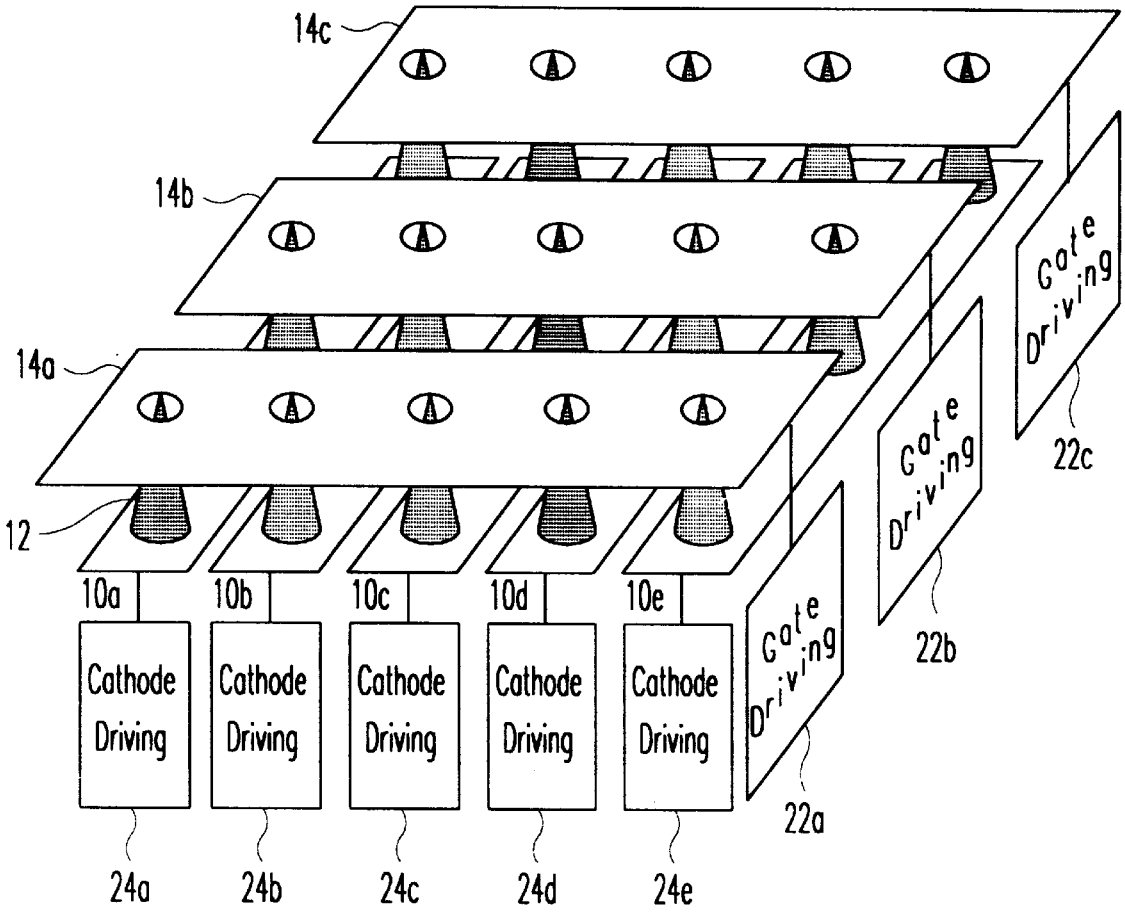
Fig. 2 (Prior Art)
FIG. 2 is a schematic diagram showing a flat display driving device according to a prior art.
Figure 3:
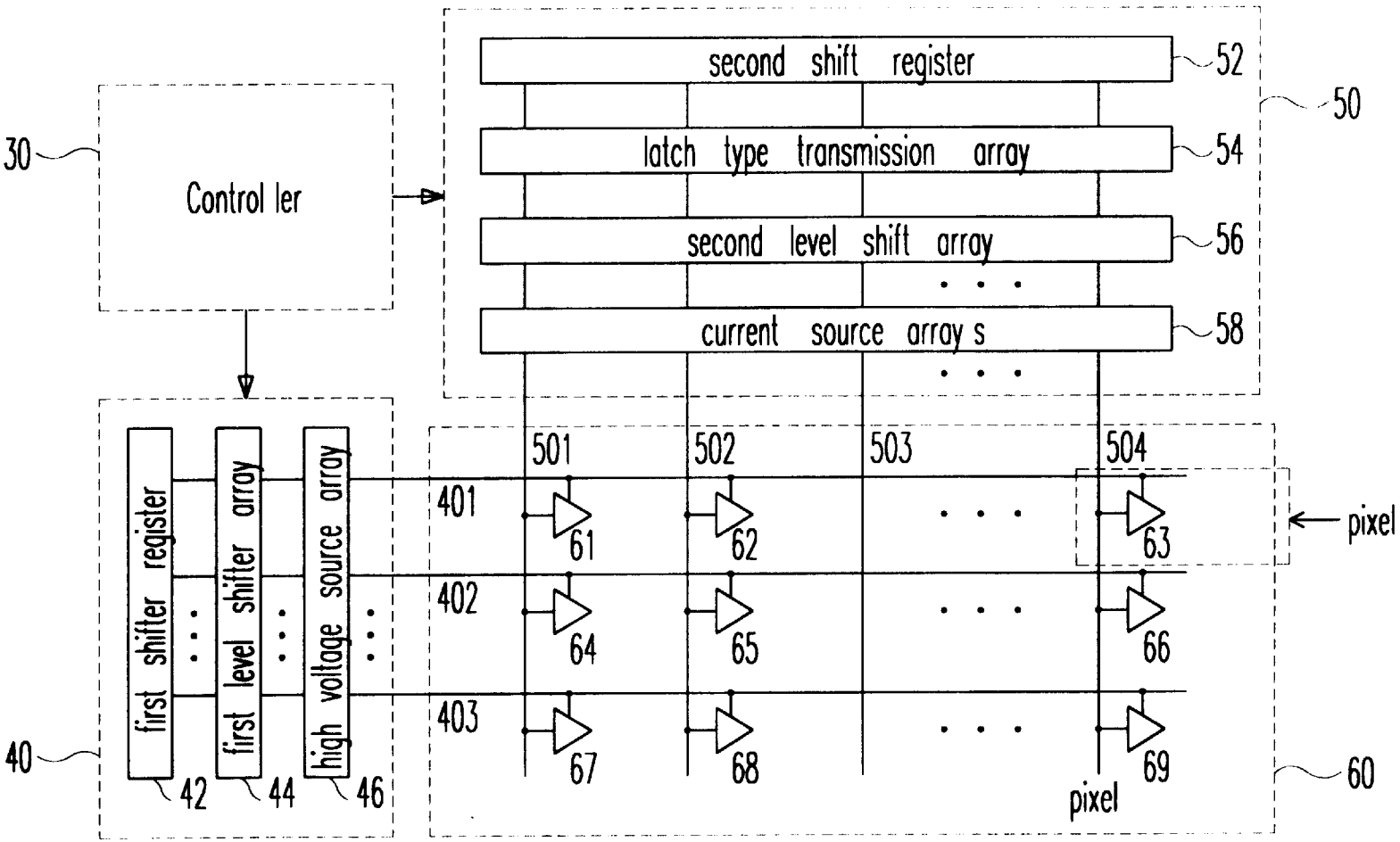
FIG. 3 is a block diagram showing a flat display driving device according to a preferred embodiment of the present invention.

FIG. 3 illustrates an FED driving device according to a preferred embodiment of the present invention. The FED driving device has a controller 30, a vertical driving unit 40 (or gate driving unit) and a horizontal driving unit 50 (or data driving unit).

Figure 4:
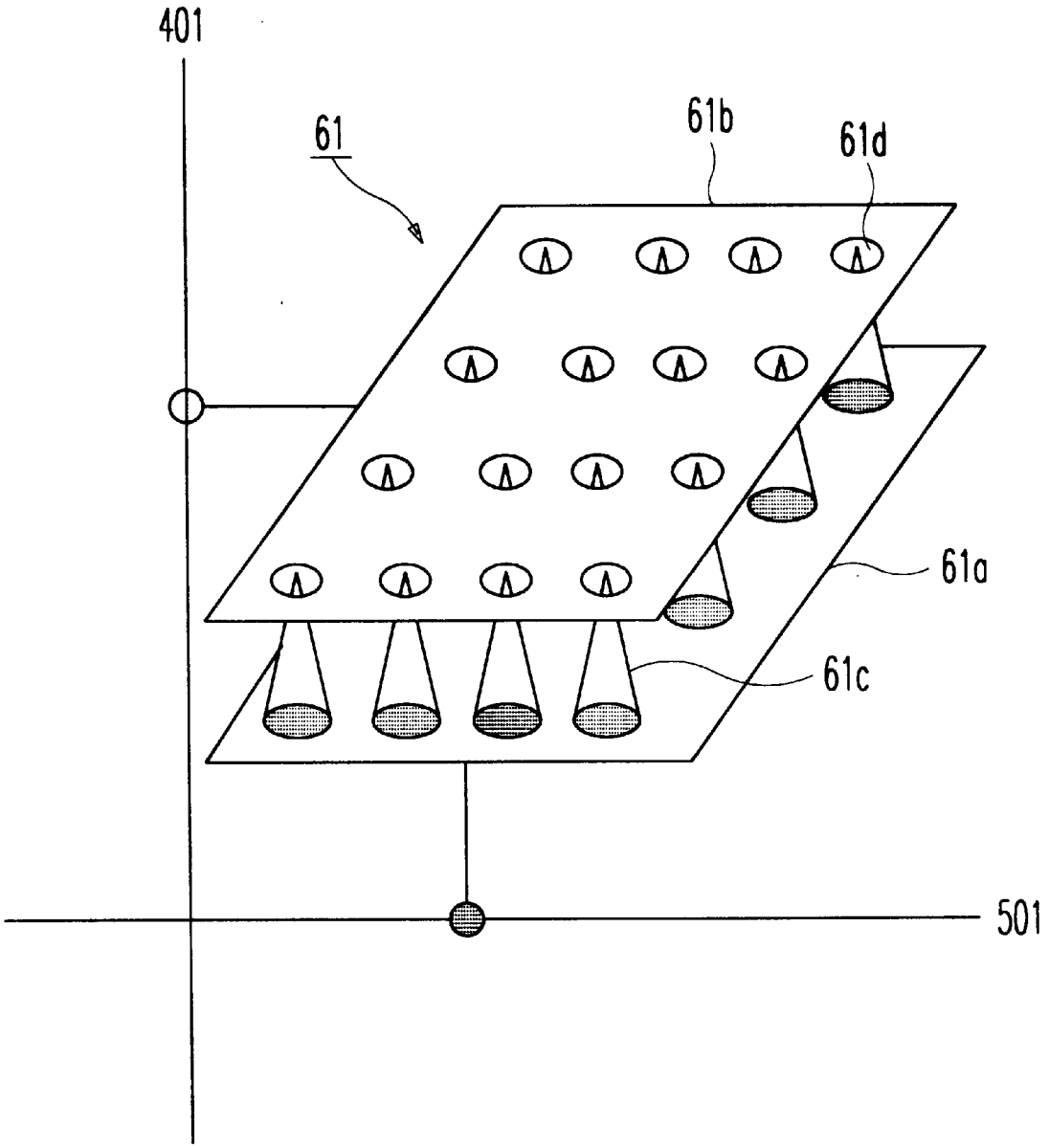
FIG. 4 is a detailed diagram showing the pixel in FIG. 3.

The FED 60 has m×n pixels 61 to 69 arranged at m gate lines 401 to 403 and n data lines 501 to 504. Each of m×n pixels is comprised of a plurality of field emission elements as shown in FIG. 4. It is better that the more field emission elements are integrated on one pixel. However, each pixel must have an identical number of field emission elements.

Referring to FIG. 4, the pixel 61 has a gate electrode plate 61*b* connected to the gate line 401 and a cathode electrode plate 61*a* connected to the data line 501. The cathode electrode plate 61*a* is arranged to be isolated from the gate electrode plate 61*b* by a predetermined interval. A plurality of cathodes 61*c* are formed over the upper surface of the cathode electrode plate 61*a,* and each cathode 61*c* is of the horn type having a pointed part. The gate electrode plate 61*b* has holes 61*d* for exposing the pointed parts of the cathodes 61*c*.

In FIG. 4, if a current signal is applied from the data line 501 to the cathode electrode plate 61*a* while one gate line 401 is applied with high voltage, the electrons corresponding to the size of the current signal are emitted from the pointed parts of the cathodes 61*c,* and the emitted electrons are accelerated by the positive plate 18 (not shown in FIG. 4) and are collided to the fluorescent film 16 (not shown in FIG. 4) doped at the positive plate 18, thus emitting light.

Returning to FIG. 3, the vertical driving unit 40 has a first shift register 42, and a level shifter 44 for driving a high voltage source array 46 in response to the output signal of the shift register 42. The first shift register 42 generates m bits of digital output signal only one bit of which has a specific logic value "1" or "0". The specific logic value is shifted from a less significant bit of the m bits of output signal to the adjacent more significant bit every time when a horizontal synchronizing signal is applied to the shift register 42. The high voltage source which is driven by the output signal having the specific logic value supplies a high voltage to the gate line corrected thereto of the m gate lines 401 to 403. By the operation of the first shift register 42 and high voltage source array 46, the m gate lines 401 to 403 sequentially and selectively maintain the high voltage for 1 horizontal period.

The vertical driving unit 40 further comprises a first level shifter array 44 connected between the first shift register 42 and the high voltage source array 46. The first level shifter array 44 serves to shift the voltage level of the m bits of output signal output from the first shift register 42 into the voltage level adequate to the high voltage source array 46.

The horizontal driving unit 50 has a second shift register 52 which has a scan pulse and sequentially inputs the pixel data from the controller 30, and a latch type transmission array 54 which sequentially inputs the pixel data from the second shift register 52 according to the scan pulse and transmits the pixel data for a predetermined time period. The second shift register 52 sequentially inputs serial type of pixel data from the controller 30 for a horizontal scan period.

The latch type transmission array 54 transmits the pixel data which is input according to a sequential pulse of the second shift register 52 for a time period corresponding to the width of the duration control pulse (DCP) applied from the controller 30.

A current source array 58 is driven while one line of pixel data is sequentially inputted from the latch type transmission array 54. Each of the current sources constituting the current source array 58 supplies the increased current according to the logic value of the pixel data to the data line connected thereto of n data lines 501 to 504.

The field emission elements constituting one pixel are collectively driven for the time period corresponding to the pulse width of the duration control pulse (DCP). The field emission elements adjust the amount of emitted electrons according to the size of the current signal.

That is, the pixels driven by the current source array 58 are driven by the pulse width of the duration control pulse for a predetermined time period, and the pulse width of the duration control pulse can be adjusted within the horizontal scan period. Thereby, a plurality of field emission elements constituting one pixel emit sufficient electrons corresponding to the pixel data.

A second level shifter array 56 connected between the latch type transmission array 54 and the current source array 58 serves to shifts the voltage level of the pixel data output from the latch type transmission array 54 into the voltage level adequate to the current source array 58.

Figure 5:
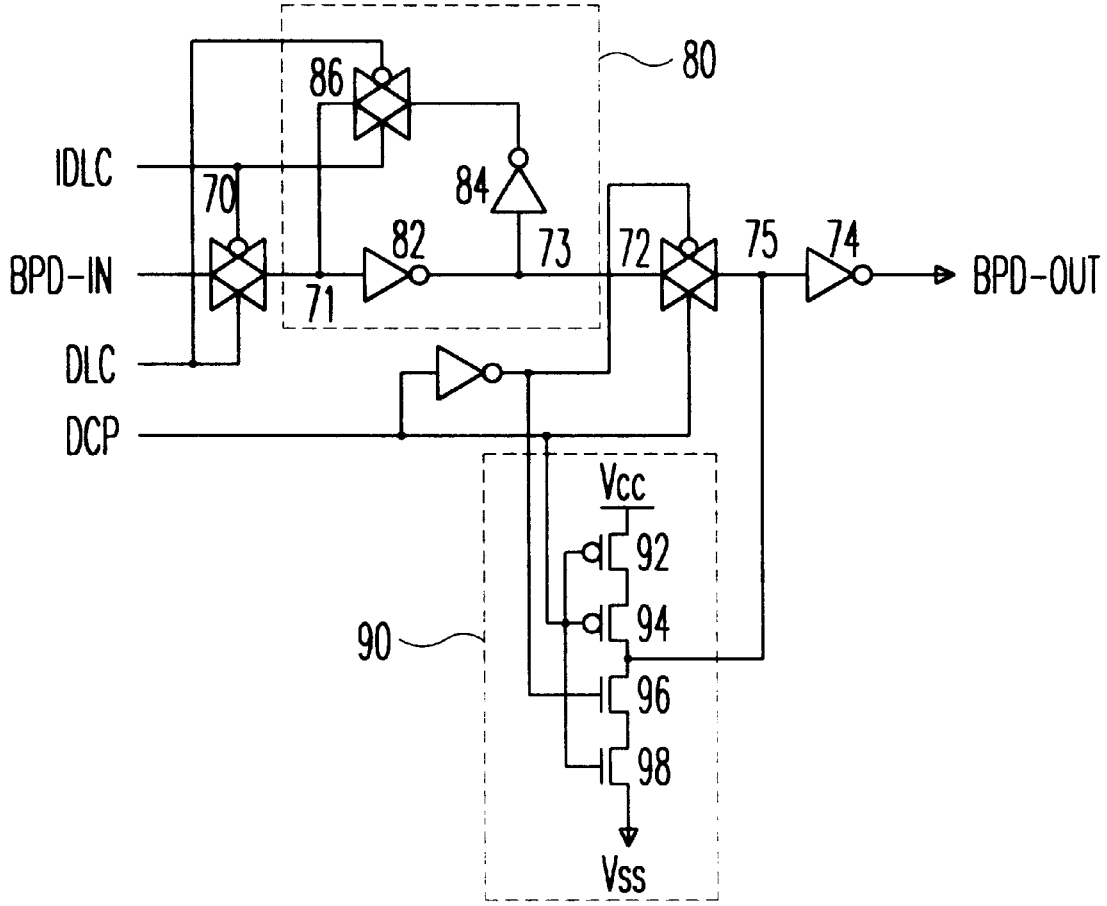
FIG. 5 is a detailed diagram showing a latch type transmitter in FIG. 3.
Figure 6:
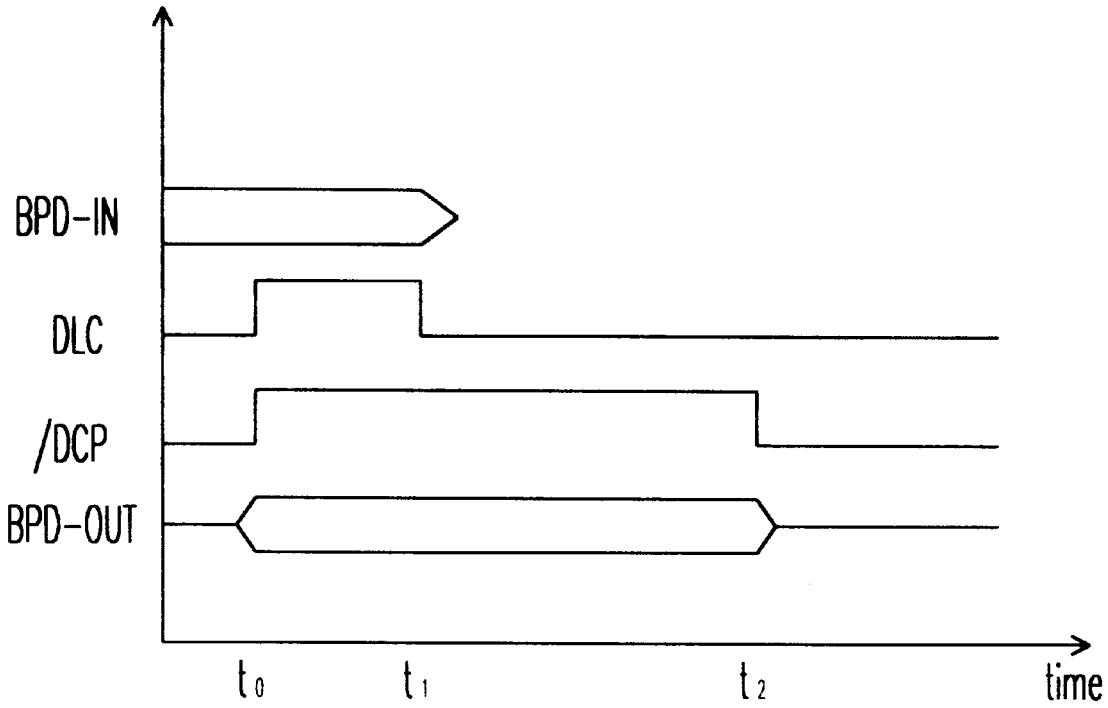
FIG. 6 is a timing diagram showing the operations of respective parts in FIG. 5.

FIG. 5 illustrates the latch type bit transmitter of the latch type transmission array of FIG. 3. The latch type bit transmitter inputs true false and complement data latch clocks DLC and /DLC and a duration control pulse DCP from the controller 30 and one bit of pixel data BPD-IN from the second shift register 52, as shown in FIG. 6. If the logic value of the pixel data BPD-IN is "0", the pixel data BPD-IN is 0 volts. In contrast, if the logic value of the pixel data BPD-IN is "1", the pixel data BPD-In maintains 5 volts. The latch type bit transmitter has a first control switch 70 for selectively transmitting the bit pixel data BPD-IN to a first node 71 and a latch circuit 80 connected between the first and second nodes 71 and 73. The first control switch 70 is selectively driven by the true-false and complement data latch clocks DLC and /DLC.

The first control switch 70 sequentially transmits gate 1 line pixel data by the second shift register 52 when the true-false data latch clock DLC maintains a logic "high" level, and one bit pixel data BPD-IN of the gate 1 line pixel data is transmitted to the first node 71.

The latch circuit 80 latches the pixel data on the first node 71 until the following pixel data is supplied to the first node 71. The latched pixel data is inverted and then transmitted via the second node 73. For this, the latch circuit 80 has third and fourth inverters 82 and 84 and a third control switch 86 between the first and second nodes 71 and 73.

The third inverter 82 inverts the pixel data on the first node 71 and the fourth inverter 64 inverts the pixel data on the second node 73. That is, the pixel data output from the fourth inverter 84 has an identical logic value to that on the first node 71. The third control switch 86 is driven by the true-false and complement data latch clocks DLC and /DLC in a complementary manner to the first control switch 70. That is, the third control switch 86 connects the output terminal of the fourth inverter 84 to the first node 71 to form a circulating loop of the third and fourth inverters 82 and 84 when the true-false data latch clock DLC is at a logic "low" level. While the circulating loop is formed, the third and fourth inverters 82 and 84 maintain the pixel data of the first node 71.

The latch type bit transmitter further comprises a second control switch 72 connected between the second and third nodes 73 and 75, a clear circuit 90 for clearing the data on the third node 75 and a first inverter 74 which inputs the data on the third node 75. The second control switch 72 selectively transmits the inverted pixel data on the second node 73 to the third node 75 in response to the duration control pulse DCP and the output signal of the second invertter 76. When the duration control pulse DCP is at the logic "high" level, the second control switch 72 transmsits the inverted pixel data on the second node 73 to the third node 75. The second inverter 76 inverts the duration control pulse DCP and provides it to the second control switch 72.

The first to third control switches 70, 72 and 86 are transmission gates each formed by the parallel-connected NMOS transistor and PMOS transistor. The clear circuit 90 is driven by the duration control pulse DCP and the output signal of the second inverter 76 in a complementary manner to the second control switch 72. That is, when the duration control pulse DCP is at the logic "low" level, the output signal BPD-OUT becomes the logic "low" level. Consequentially, while the pixel data is not outputted, i.e. when the duration control pulse DCP is "0", the clear circuit 90 clears the current of the current source so that the electrons cannot be emitted from the field emission elements. For this, the clear circuit 90 has first and second PMOS transistors 92 and 94 series-connected between a power supply voltage Vcc and the third node 75, and first and second NMOS transistors 96 and 98 series-connected between the third node 75 and a ground voltage Vss.

The duration control signal DCP is commonly applied to the gates of the first and second PMOS transistors 92 and 94 and second NMOS transistor 98, and an inverted duration control signal is applied to the gate of the first NMOS transistor 96. If the duration control signal DCP is at a logic "low" level, the first and second PMOS transistors 92 and 94 and the first NMOS transistor 96 are turned on, while the second NMos transistor 98 is turned off. Therefore, a current path is formed between the power supply voltage Vcc and the third node 75. Thus, the third node 75 generates a logic "high" signal. The output signal, BPD-OUT becomes a logic "low" level, thus turning off the current source.

If the duration control signal DCP is at a logic "high" level, the first and second PMOS transistors 92 and 94 and the first NMOS transistor 96 are turned off, while the second NMOS transistor 98 is turned on. Thereby, the third node 75 maintains a high impedance state, enabling the input of the input voltage from the bit pixel data BPD-IN.

Consequentially, the reason why the clear circuit 90 is added to the latch type bit transmitter is to accurately control the amount of the electrons emitted from the field emission elements. That is, in the case that the latch type bit transmitter does not have the clear circuit 90, if the duration control signal DCP goes to the logic "low" level, the third node 75 maintains the high impedance state and the current source element is not accurately turned off by the charge remained at the parasitic capacitor between the gate and source of the current source element. Thereby, electrons may be irregularly emitted from the field emission elements even after the duration control signal DCP goes from the logic "high" state to the logic "low" state. In order to solve this problem, the clear circuit 90 is added to the latch type bit transmitter in the present invention.

Finally, the first inverter 74 inverts the data on the third node 75 and supplies the bit pixel data BPD-OUT as shown in FIG. 6 to the second level shifter array 56 shown in FIG. 3.

As described above, the flat display driving device of the present invention collectively drives a plurality of field emission elements by the current signal and adjusts the driving time of the pixel using the latch type transmitter, thus enabling sufficient driving of the pixels.

Therefore, it should be understood that the present invention is not limited to the particular embodiment disclosed herein as the best mode contemplated for carrying out the present invention, but rather that the present invention is not limited to the specific embodiment described in this specification except as defined in the appended claims.

What is claimed is:

1. A flat display driving device wherein a plurality of data lines are arranged in parallel with one another in a vertical direction, a plurality of gate lines are arranged in parallel with one to another in a horizontal direction and a plurality of pixels are connected to said plurality of data lines and gate lines, and each pixel consists of a plurality of field emission elements, said flat display driving device comprising:

A) gate driving means for sequentially and selectively applying a high voltage to said plurality of gate lines to drive them;

B) cathode data driving means for a current signal supplied, simultaneously emit the electrons corresponding to the magnitude of the current signal;

C) said cathode driving means including;

I) a shift register for sequentially inputting one line of pixel data;

II) a current source array which inputs said one line of pixel data from said shift register, generates one line of current signals corresponding to each logic value of said pixel data and applies said one line of current signals to said plurality of data lines; and a latch type transmission array connected between said shift register and said current source array, for adjusting the supply time of said one line of pixel data to be applied to said current source array, thereby driving the pixels on one horizontal line of the flat display by said current signals for a predetermined time period;

D) control driving means which processes a video signal into a series of pixel data, supplies it to said cathode data driving means and generates control signals required for said cathode data driving means and gate driving means; and E) said latch type transmission array has latch type bit transmission circuits, each circuit comprising:

I) memory means for storing one bit of pixel data from said shift register;

II) a first control switch connected between said shift register and said memory means, for selectively latching said one bit of pixel data by a data latch clock output from said control means; and III) a second control switch connected between said memory means and said current source array, for adjusting the supply time of said one bit of pixel data to be supplied to said current source array by a duration control pulse output from said control means.

2. The flat display driving device as claimed in claim 1, wherein said memory means comprises two inverters connected between said first and second control switches to form a circulating loop.

3. The flat display driving device as claimed in claim 2, wherein said memory means further comprises a third control switch which is connected between said two inverters and is driven by said data latch clock in a complementary manner to said first control switch, thus opening/closing said circulating loop.

4. The flat display driving device as claimed in claim 3, wherein said latch type bit transmission circuit further comprises buffer means connected between said second control switch and said current source array, for buffering said pixel data supplied fronm said second control switch.

5. The flat display driving device as claimed in claim 1, wherein said latch type bit transmission circuit further comprises initialization means which is driven by said duration control pulse in a complementary manner to said second control switch and initializes the pixel data to be supplied to said current source array.

6. The flat display driving device as claimed in claim 5, wherein said latch type bit transmission circuit further comprises a level shifter connected between said initialization means, said second control switch and said current source array, for shifting the voltage level of the data from said initialization means and second control switch into the voltage level adequate to said current source array.

7. The flat display driving device as claimed in claim 6, wherein each of said first and second control switches includes parallel connected NMOS transistor and PMOS transistor.

8. The flat display driving device as claimed in claim 5, wherein said initialization means comprises two series-connected NMOS transistors and two series-connected PMOS transistors which are connected in series to said series-connected NMOS transistors and thus supplies the output signal of high voltage or the output signal of high-impedance state to said current source array.

9. The flat display driving device as claimed in claim 1, further comprising a level shifter array connected between said latch type transmission array and said current source array, for shifting the voltage level of said one line of pixel data output from said latch type transmission array into the voltage level adequate to said current source array.

* * * * *